US006954182B2

(12) United States Patent
Knapp

(10) Patent No.: US 6,954,182 B2
(45) Date of Patent: Oct. 11, 2005

(54) CONDUCTIVE STRUCTURES INCLUDING AIRCRAFT ANTENNAE AND ASSOCIATED METHODS OF FORMATION

(75) Inventor: Jeffrey Knapp, Seattle, WA (US)

(73) Assignee: The Insitu Group, Inc., Bingen, WA (US)

( * ) Notice: Subject to any disclaimer, the term of this patent is extended or adjusted under 35 U.S.C. 154(b) by 0 days.

(21) Appl. No.: 10/758,293

(22) Filed: Jan. 15, 2004

(65) Prior Publication Data

US 2004/0207560 A1 Oct. 21, 2004

Related U.S. Application Data

(60) Provisional application No. 60/440,681, filed on Jan. 17, 2003.

(51) Int. Cl.[7] ..... H01Q 1/28
(52) U.S. Cl. ..... 343/705; 343/795
(58) Field of Search ..... 343/700 MS, 705, 343/708, 793, 795

(56) References Cited

U.S. PATENT DOCUMENTS 3,713,162 A * 1/1973 Munson et al. ..... 343/705
6,056,237 A * 5/2000 Woodland ..... 244/3.15
6,056,327 A 5/2000 Bouldin et al.
6,653,980 B2 * 11/2003 Ceccom et al. ..... 343/705
2002/0186170 A1 12/2002 Ceccom et al.

FOREIGN PATENT DOCUMENTS

WO WO-04-066433 A2 8/2004

OTHER PUBLICATIONS

International Search Report for PCT/US04/01201; Jan. 2004; Applicant: The Insitu Group (5 pgs).
U.S. Appl. No. 10/758,294, Jackson.

* cited by examiner

*Primary Examiner*—Shih-Chao Chen
(74) *Attorney, Agent, or Firm*—Perkins Coie LLP

(57) ABSTRACT

Conductive structures, including aircraft antennae and associated methods of formation, are disclosed. An antenna in accordance with one embodiment of the invention can include a flexible circuit material having a substrate and at least one conductive layer adjacent to the substrate. The flexible circuit material can be rolled to form a cylindrical or partially cylindrical antenna, such as a dipole antenna. The conductive material can further include circuit elements, such as leads, conductive lines, vias, and/or other elements electrically coupled to the antenna. The flexible circuit material can also support a transmitter and/or receiver that is coupled to the antenna via the circuitry. Accordingly, the antenna can be formed integrally with the circuitry and can be configured and positioned for enhanced signal reception and/or transmission.

54 Claims, 7 Drawing Sheets

Enter dimensions:

| | | |
|---|---|---|
| Trace width (W) | 8 | mils |
| Trace thickness (T) | 4 | mils |
| Trace spacing (S) | 20 | mils |
| Distance between planes (B) | 14 | mils |
| Relative Dielectric constant (Er) | 3.5 | |
| Compute Z | | |
| Differential Trace Impedance | 62.5 | ohms |

CONDUCTIVE STRUCTURES INCLUDING AIRCRAFT ANTENNAE AND ASSOCIATED METHODS OF FORMATION

CROSS-REFERENCE TO RELATED APPLICATION

The present application claims priority to pending U.S. Provisional Application No. 60/440,681, filed Jan. 17, 2003 and incorporated herein in its entirety by reference.

TECHNICAL FIELD

The present disclosure describes conductive structures, including aircraft antennae, and methods for forming such conductive structures.

BACKGROUND

Unmanned aircraft or air vehicles (UAVs) provide enhanced and economical access to areas where manned flight operations are unacceptably costly and/or dangerous. For example, unmanned aircraft outfitted with remotely controlled cameras can perform a wide variety of surveillance missions, including spotting schools of fish for the fisheries industry, monitoring weather conditions, providing border patrols for national governments, and providing military surveillance before, during and/or after military operations.

Unmanned aircraft typically communicate with ground stations via radio frequency transmitters and receivers. Accordingly, conventional unmanned aircraft include both transmitting and receiving antennae. One drawback with some conventional unmanned aircraft antennae is that they may lack adequate power for long-range communication. Another drawback is that some existing antennae may not integrate well with the aircraft aerodynamics. For example, some conventional antennae extend outwardly away from the aircraft fuselage or wing surfaces, increasing the overall drag of the aircraft and the risk of damage to the antennae. Still another drawback is that the connections between the circuitry attached to the antennae and the antennae themselves may in some cases be unreliable or vulnerable to damage. If the antennae or their connections fail, the aircraft can lose communication with the ground station and can accordingly fly in an uncontrolled manner and/or fail to receive and/or transmit data.

DETAILED DESCRIPTION

The present disclosure describes antennae for aircraft, such as unmanned aircraft, and corresponding methods for forming antennae and other conductive structures, such as coaxial conductors. Many specific details of certain embodiments of the invention are set forth in the following description and in FIGS. 1–11 to provide a thorough understanding of these embodiments. One skilled in the art, however, will understand that the present invention may have additional embodiments, and that the invention may be practiced without several of the details described below.

Figure 1:
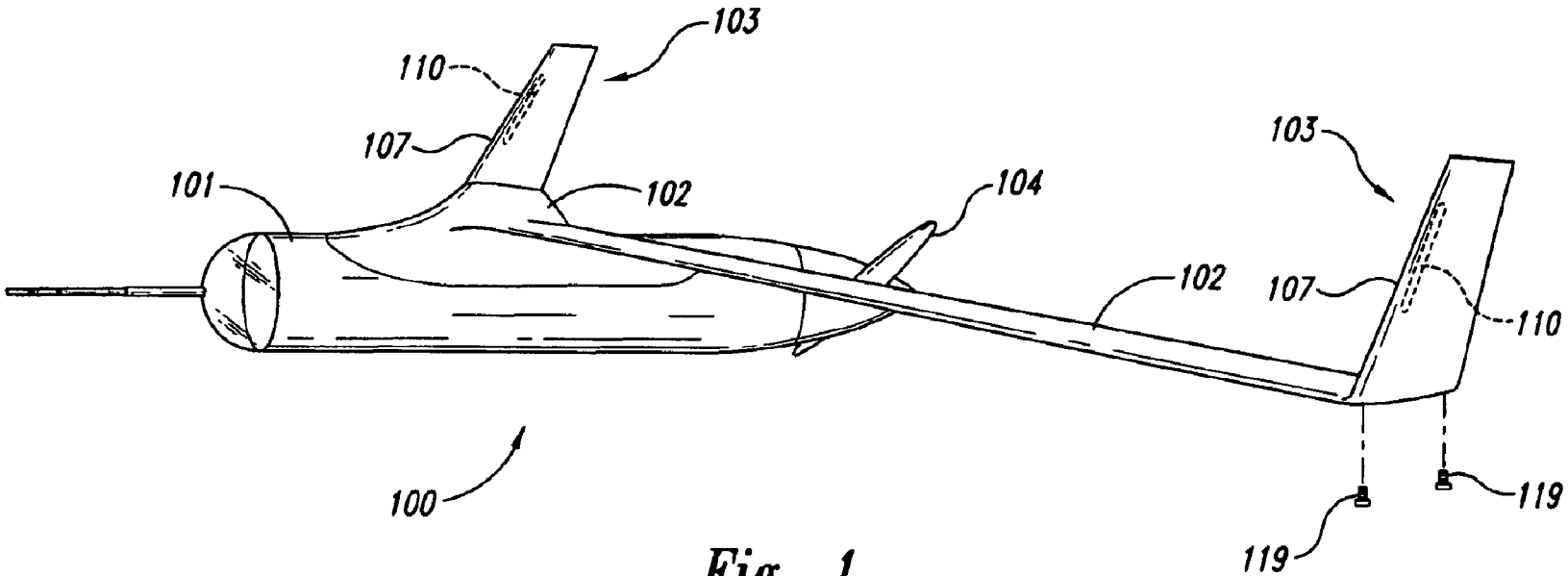
FIG. 1 is a partially schematic, front isometric illustration of an aircraft having a plurality of antennae configured in accordance with an embodiment of the invention.

FIG. 1 is a partially schematic, isometric illustration of an aircraft 100 having antenna assemblies 110 configured in accordance with an embodiment of the invention. In one aspect of this embodiment, the unmanned aircraft 100 can include a fuselage 101, a pair of wings 102 extending outwardly from the fuselage 101, and a propeller 104 positioned at the aft end of the fuselage 101 to propel the aircraft 100 during flight. The aircraft 100 can further include upwardly extending winglets 103, each of which can be connected to one of the wings 102 with fasteners 119, and each of which is positioned to provide the aircraft 100 with lateral stability and control. An antenna assembly 110 can be installed at a forward leading edge 107 of each winglet 103 to provide for communication between the aircraft 100 and other devices, including a control station (not shown). Further details of the formation and installation of the antenna assembly 110 are provided below with reference to FIGS. 2–11.

Figure 2:
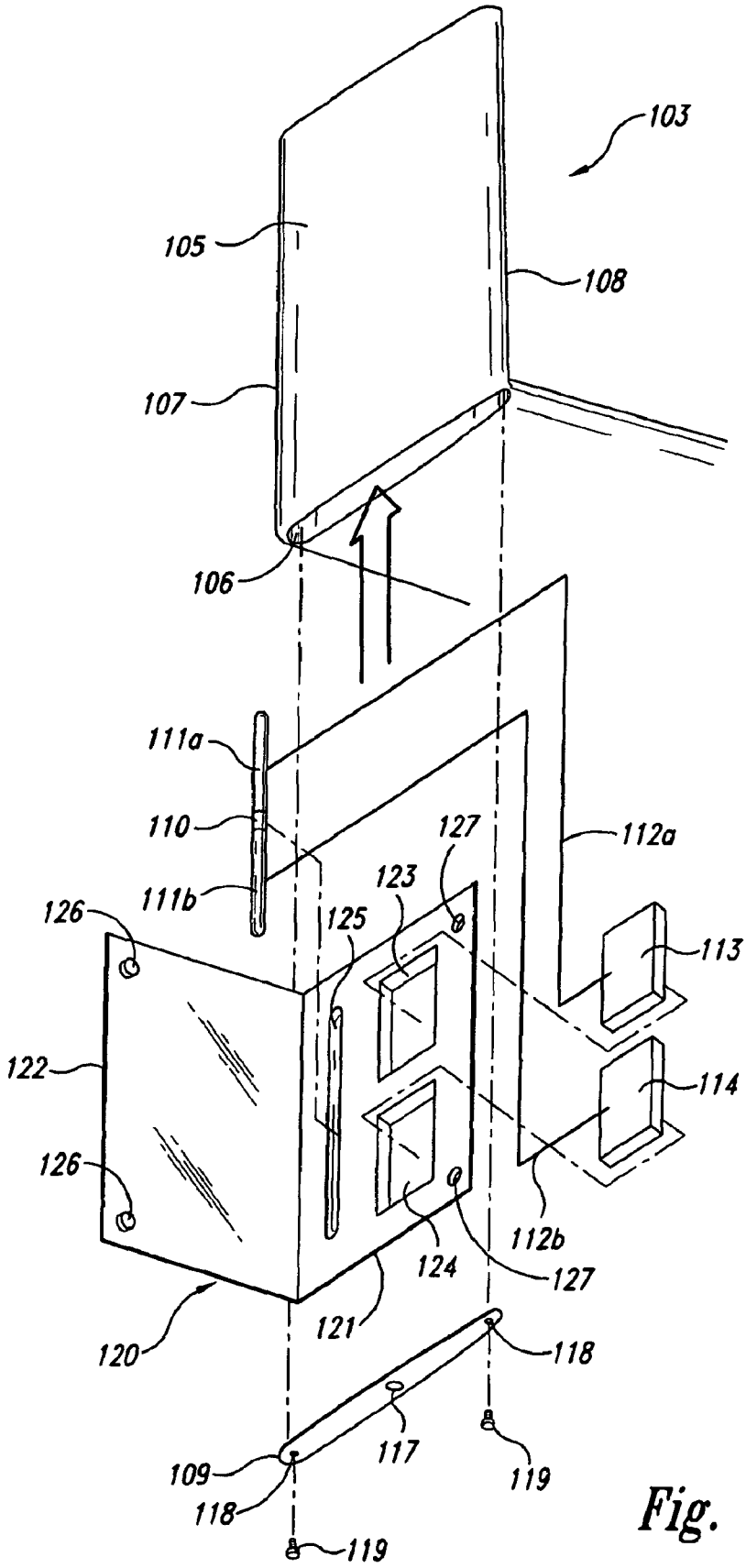
FIG. 2 is a partially exploded, bottom isometric view of a winglet having an antenna assembly installed in accordance with an embodiment of the invention.

FIG. 2 is a partially exploded, partially schematic isometric illustration of one of the winglets 103, configured to house an antennae assembly 110 in accordance with an embodiment of the invention. In one aspect of this embodiment, the winglet 103 includes two opposing winglet surfaces 105 and has a trailing edge 108 facing away from the leading edge 107. In one aspect of this embodiment, the winglet surfaces 105 can be transparent or translucent to allow visual access to the region inside the winglet 103.

In a further aspect of this embodiment, the winglet 103 can include an opening 106 sized to receive a support member 120. The support member 120 can carry the antenna assembly 110 and corresponding signal transmission and reception equipment. For example, in one embodiment, the antenna assembly 110 can include a plurality of antennas 111 (shown in FIG. 2 is a first antenna 111*a* and a second antenna 111*b*). In one aspect of this embodiment, the first antenna 111*a* can include a transmission antenna coupled to a transmitter module 113 with one or more first leads 112*a* (one is shown in FIG. 2 for purposes of illustration). The second antenna 111*b* can include a receiving antenna coupled to a receiver module 114 with one or more second leads 112*b* (one is shown in FIG. 2 for purposes of illustration). Accordingly, a single antenna assembly 110 can both transmit and receive signals related to the operation of the aircraft 100 (FIG. 1) and/or the data collected by the aircraft 100.

In a further aspect of an embodiment shown in FIG. 2, the support member 120 can be configured to releasably carry the antenna components described above. For example, the support member 120 can include a receptacle portion 121 having a transmitter receptacle 123 positioned to releasably receive the transmitter module 113, a receiver receptacle 124 positioned to releasably receive the receiver module 114, and an antenna receptacle 125 positioned to releasably receive the antenna assembly 110. The transmitter module 113, the receiver module 114, and/or the antenna assembly 110 can be removably received in the receptacle portion 121 in a "snap-fit" arrangement. For example, the receptacles 123–125 can be slightly undersized and can be formed from a resilient material (such as a thermally molded plastic) to exert a compressive force on the components they receive. In another embodiment, the receptacles 123–125 can include features (such as projections) that releasably interlock with corresponding features (such as recesses) of the antenna components. In any of these embodiments, the support member 120 can further include a cover portion 122 hingedly coupled to the receptacle portion 121 to protect and further secure the components contained in the receptacle portion 121. In a particular aspect of this embodiment, the cover portion 122 can include locking tabs 126 that are securely and releasably received in lock receptacles 127, also in a snap-fit configuration.

In one embodiment, the transmitter module 113, the receiver module 114, and the antenna assembly 110 can be releasably positioned in the receptacle portion 121, and the cover 122 can be releasably secured to the receptacle portion 121. The closed support member 120 can then be inserted into the opening 106 of the winglet 103, with the antenna assembly 110 positioned proximate to the leading edge 107 of the winglet 103. When the antenna assembly 110 in this position, the antennas 111 have a forward facing, vertical orientation, which can be particularly suitable for receiving and/or transmitting signals.

Once the support member 120 is inserted into the winglet 103, the opening 106 of the winglet 103 can be closed with an end cap 109. The end cap 109 can have holes 118 to receive the fasteners 119 described above with reference to FIG. 1. The end cap 109 can further include a connector opening 117 sized and positioned to receive a connector (not shown in FIG. 2) that couples the circuitry in the winglet 103 to circuitry in other portions of the aircraft 100 (FIG. 1). Further details of support member arrangements are described in U.S. application Ser. No. 10/758,294, entitled "Method and Apparatus for Supporting Aircraft Components, Including Actuators," filed Jan. 15, 2004 and incorporated herein in its entirety by reference.

Figure 3:
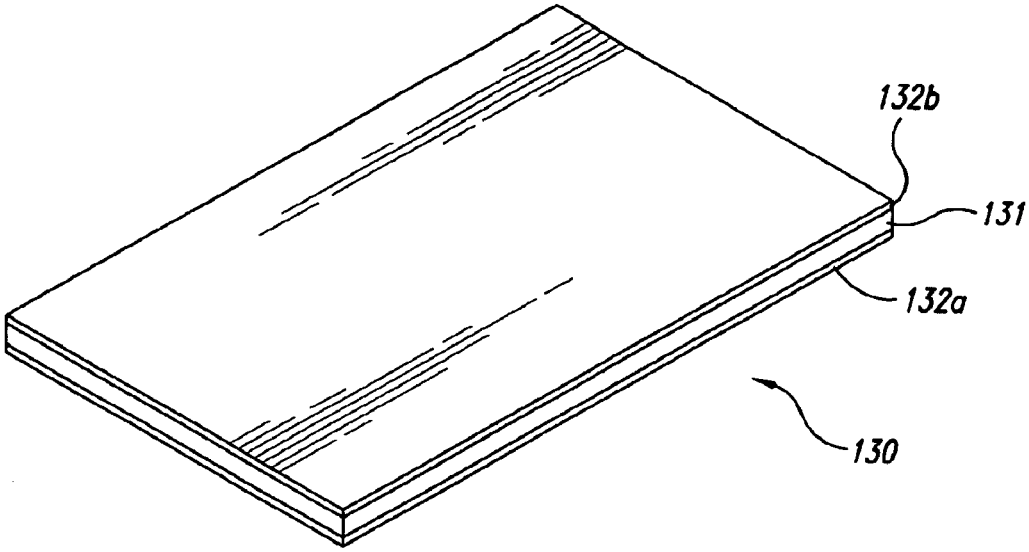
FIG. 3 is a partially schematic, top isometric view of a flexible circuit material used to form an antenna in accordance with an embodiment of the invention.

FIG. 3 is a partially schematic, isometric illustration of a flexible circuit material 130 that can be used to form antenna assemblies (including the antenna assembly 110 described above with reference to FIG. 2) in accordance with an embodiment of the invention. In one aspect of this embodiment, the flexible circuit material 130 can include a substrate 131 formed from a flexible, low dielectric constant insulator, such as Kapton® or other polyimides. The flexible circuit material 130 can further include one or more conductive layers 132 (two are shown in FIG. 3 as a first conductive layer 132*a* adjacent to one face of the substrate 131 and a second conductive layer 132*b* adjacent to the opposite face of the substrate 131). The conductive layers 132 can include a low resistivity conductive material, such as copper, that can be selectively removed from the substrate 131 to form circuit elements, such as leads and/or conductive traces, using generally available techniques.

Figure 4:
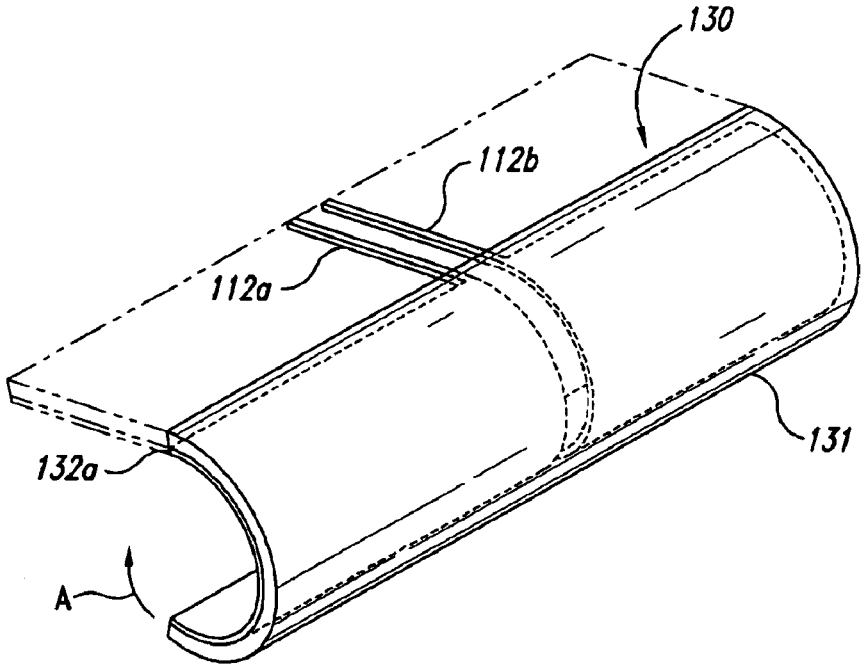
FIG. 4 is a partially schematic, isometric view of a flexible circuit material being rolled to form an antenna assembly in accordance with an embodiment of the invention.

Referring now to FIG. 4, the flexible circuit material 130 can be processed to form one or more antennae, such as the antennae 111 shown in FIG. 2. For example, in one embodiment, the second conductive layer 132*b* can be removed from the flexible circuit material 130, as can a portion of the substrate 131 indicated in dashed lines in FIG. 4. A portion of the remaining first conductive layer 132*a* can also be removed, such that the remaining conductive material from the first conductive layer 132*a* forms the first and second leads 112*a*, 112*b*. In one embodiment, the conductive material can be processed to form one first lead 112*a* and one second lead 112*b*. In other embodiments (such as those described below with reference to FIGS. 6–11), the conductive material can be processed to form more leads, for example, two first leads 112*a* and two second leads 112*b*.

In any of the foregoing embodiments, additional portions of the first conductive layer 132*a* (adjacent to the substrate 131) can remain intact. The flexible circuit material 130 can then be rolled or otherwise formed (for example, around a mandrel) into a cylindrical shape, as indicated by arrow A in FIG. 4. In one embodiment, the cylinder can have an open side. In other embodiments, the edges of the flexible circuit material 130 can be joined, for example, as described below with reference to FIG. 5.

Figure 5:
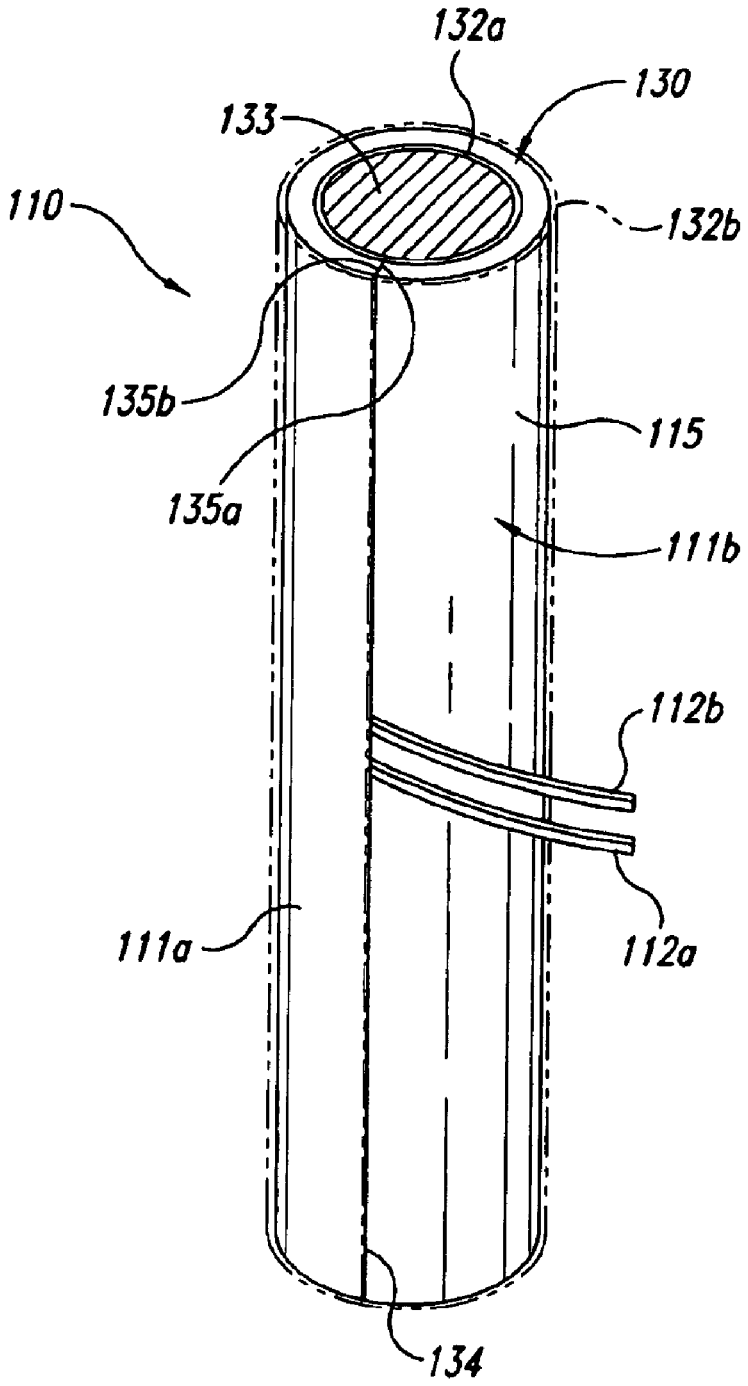
FIG. 5 is a partially schematic, isometric illustration of an antenna assembly formed in accordance with an embodiment of the invention.

Referring now to FIG. 5, the flexible circuit material 130 can be rolled up through an angle of 180 degrees so that opposing edges 135*a*, 135*b* abut each other, forming a closed cylinder 115. The abutting edges 135*a*, 135*b* can be joined at a seam 134 so that the flexible circuit material 130 retains a cylindrical shape. In one aspect of this embodiment, the abutting edges of the first conductive layer 132*a* can be joined at the seam 134 with an electrically conductive bond (for example, using soldering or welding techniques), and the abutting edges of the substrate 131 can be joined at the seam 134 with a non-conductive bond (for example, using a non-conductive epoxy adhesive). In other embodiments, the edges 135*a*, 135*b* of the flexible circuit material can be overlapped rather than butted when joined, as described in greater detail below with reference to FIGS. 10A–10B.

In another aspect of an embodiment shown in FIG. 5, a support material 133 (which can include epoxy or other suitable materials) can be disposed in the interior of the cylinder 115 formed by the flexible circuit material 130. The leads 112*a*, 112*b* can be routed out through the cylinder 115 at the seam 134 for connections to signal transmission and/or reception equipment. The resulting antenna assembly 110 can include the first antenna 111*a* coupled to the first lead 112*a*, and the second antenna 111*b* coupled to the second lead 112*b*. The antenna assembly 110 can then be installed in the winglet 103 (as described above with reference to FIG. 2), or in another portion of the aircraft 100 (FIG. 1).

In other embodiments, the antenna assembly 110 can have configurations other than those described above. In still further embodiments, the foregoing techniques can be used to form other conductive structures, such as coaxial conductors. Accordingly, the conductive layers 132*a* and 132*b* can remain continuous (as indicated in FIG. 5 with solid lines for the first conductive layer 132*a* and phantom lines for the second conductive layer 132*b*) and the first and second leads 112*a*, 112*b* can be eliminated.

Figure 6:
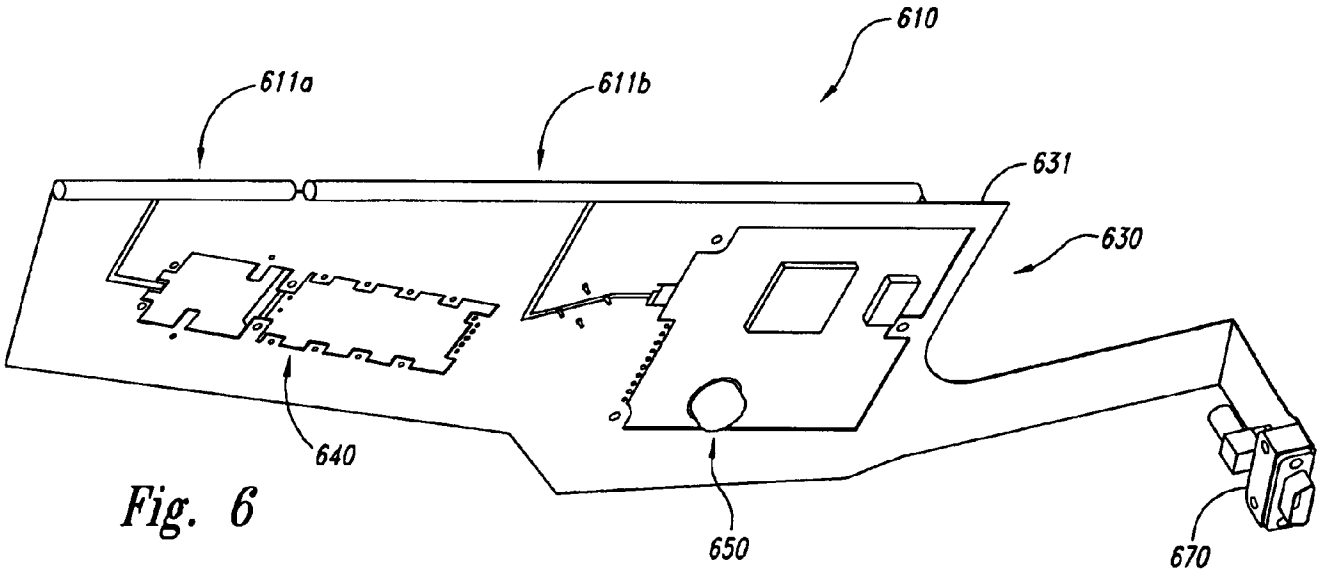
FIG. 6 is a partially schematic, isometric illustration of an antenna assembly configured in accordance with another embodiment of the invention.

FIGS. 6–11 illustrate an antenna assembly 610 (and associated methods for its formation) in accordance with further embodiments of the invention. Referring first to FIG. 6, the antenna assembly 610 can include a flexible circuit material 630 having a substrate 631 and formed to include two antennae 611 (shown as a first antenna 611*a* and a second antenna 611*b*). In one embodiment, the first antenna 611*a* can include a transmitter antenna and the second antenna 611*b* can include a receiver antenna. In a further aspect of this embodiment, each of the antennae can have a ¼ wavelength dipole configuration. In a particular embodiment, the first antenna 611*a* can be configured to transmit signals at 2400 MHz and the second antenna 611*b* can be configured to receive signals of 900 MHz. In other embodiments, the antenna assembly 610 can include more or fewer antennae 611 having similar or different configurations, depending upon the uses intended for the antenna assembly 610.

In one aspect of an embodiment shown in FIG. 6, the flexible circuit material 630 can further include a transmitter portion 640 and a receiver portion 650. The transmitter portion 640 can carry a transmitter and associated circuitry electrically coupled to the first antenna 611*a*. The receiver portion 650 can carry a receiver and corresponding circuitry electrically coupled to the second antenna 611*b*. A connector 670 can provide for electrical communication between the transmitter portion 640, the receiver portion 650, and other devices and components of the aircraft 100 described above with reference to FIG. 1.

Figure 7:
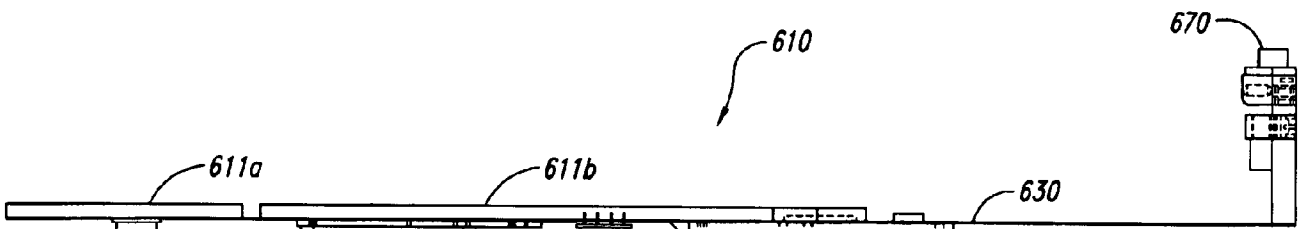
FIG. 7 is a side elevation view of an embodiment of the antenna assembly shown in FIG. 6.

FIG. 7 is a side elevation view of an embodiment of the antenna assembly 610 shown in FIG. 6. As shown in FIG. 7, the transmitter portion 640 of the flexible circuit material 630 can carry a transmitter module 613 coupled to a transmitter filter 641, both of which are coupled to the first antenna 611*a*. In a particular aspect of this embodiment, the transmitter module 613 can include an 800 mW video transmitter and the transmitter filter 641 can include a 2400 MHz bandpass filter. In other embodiments, these components can have other configurations. The receiver portion 650 can include a receiver module 614 and a receiver filter 651, both of which are coupled to the second antenna 611*b*. In a particular aspect of this embodiment, the receiver module 614 can include a 900 MHz modem available from FreeWave of Boulder, Colo., and the receiver filter 651 can include a 900 MHz bypass filter. In other embodiments, these components can have other configurations. Further details of the interconnections between these components are described below with reference to FIGS. 8–11.

Figure 8:
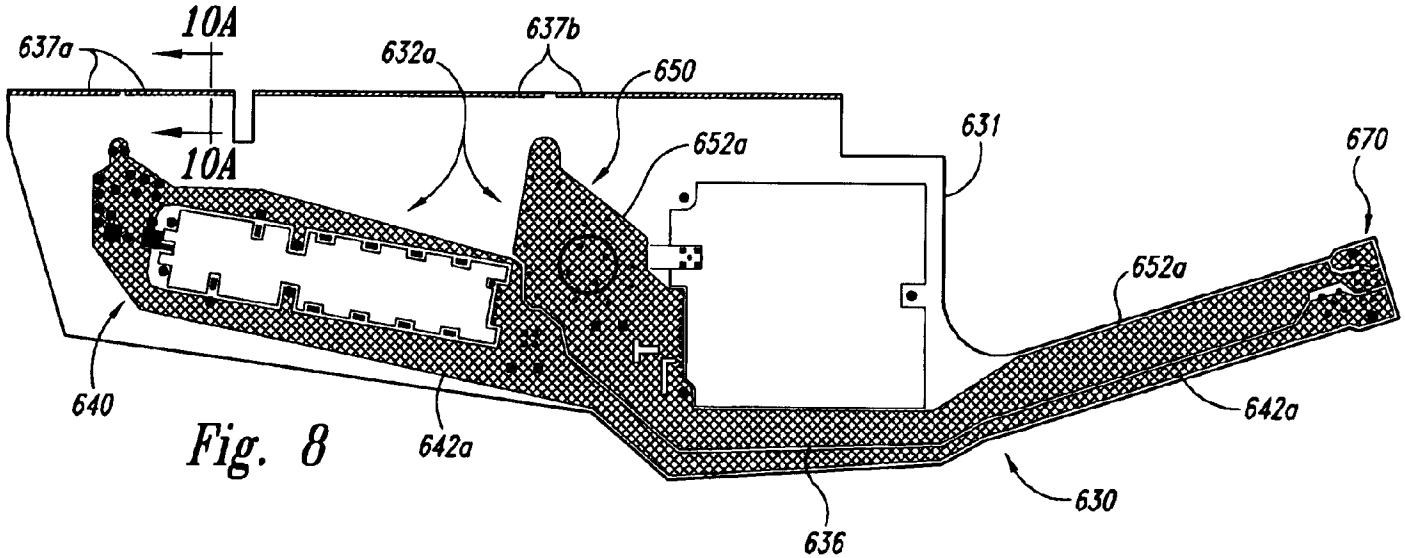
FIG. 8 is a partially schematic, plan view of a flexible circuit material having a substrate and a first conductive layer configured in accordance with an embodiment of the invention.

FIG. 8 is a partially schematic, top plan view of a portion of the flexible circuit material 630, including the substrate 631 and a first conductive layer 632*a* positioned adjacent to a lower surface of the substrate 631. For purposes of illustration, the substrate 631 is shown as being transparent in FIG. 8 so that the first conductive layer 632*a* is visible. The first conductive layer 632*a* can be processed, for example, by subtractive etch techniques, to form a first transmitter ground plane 642*a* and a first receiver ground plane 652*a*. The first transmitter ground plane 642*a* can be electrically isolated from the first receiver ground plane 652*a* by a gap 636. Accordingly, the first transmitter ground plane 642*a* can provide a ground bus and shielding for components of the transmitter portion 640, and the first receiver ground plane 652*a* can provide an electrically isolated ground bus and shielding for components of the receiver portion 650.

The first conductive layer 632*a* can further include first antenna overlap connectors 637*a* and second antenna overlap connectors 637*b*. As described in greater detail below with reference to FIGS. 10A–10B, the overlap connectors 637*a*, 637*b* can provide electrical continuity for the cylindrical, dipole antennas 611*a*, 611*b* shown in FIGS. 6–7.

Figure 9:
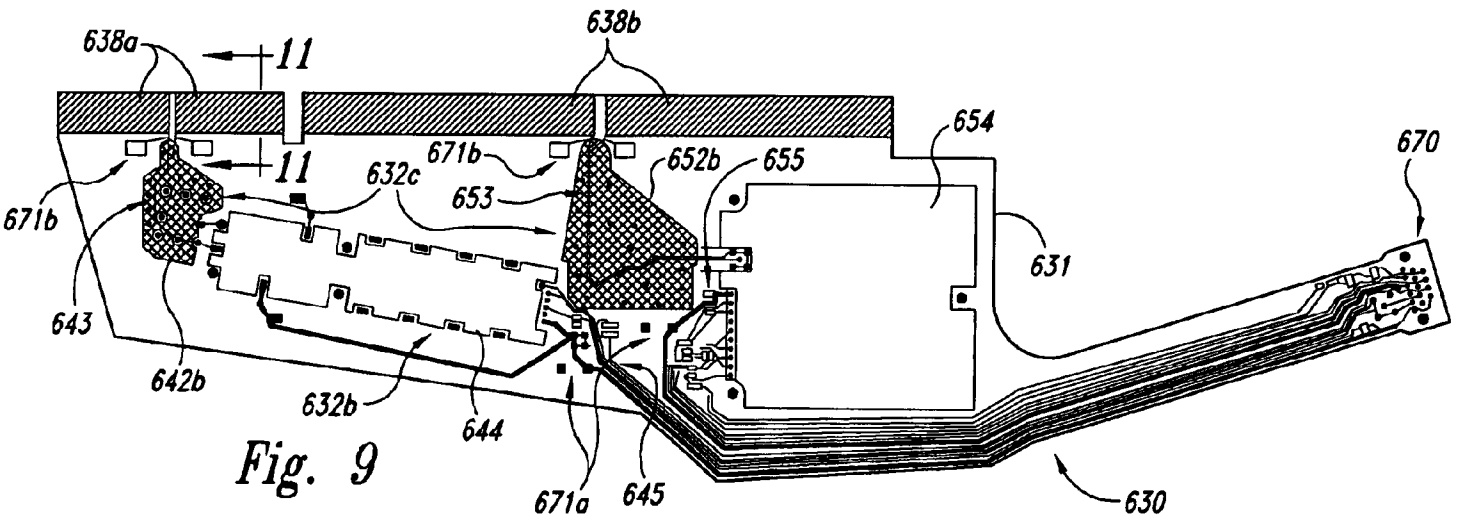
FIG. 9 is a partially schematic, plan view of the flexible circuit material shown in FIG. 8 with second and third conductive layers visible.

FIG. 9 is a top plan view of the flexible circuit material 630, illustrating aspects of a second conductive layer 632*b* positioned adjacent to an upper surface of the substrate 631, and a third conductive layer 632*c* positioned on top of portions of the second conductive layer 632*b*. For purposes of illustration, the first conductive layer 632*a* shown in FIG. 8 and positioned on the opposite side of substrate 631 is not shown in FIG. 9.

In one aspect of an embodiment of the flexible circuit material 630 shown in FIG. 9, the second conductive layer 632*b* can include first antenna conductor portions 638*a*. As described in greater detail below with reference to FIGS. 10A–10B, the first antenna conductor portions 638*a* can be formed into a generally cylindrical first antenna. This second conductive layer 632*b* can further include a transmitter module connection site 644 having conductive terminals positioned to receive corresponding connections from the transmitter module 613 (FIG. 7). The second conductive layer 632*b* can still further include transmitter circuitry 645 which connects the transmitter module connection site 644 with the connector 670, and first antenna leads 643 which connect the transmitter module connection site 644 with the first antenna conductor portions 638*a*.

The second conductive layer 632*b* can also include second antenna conductor portions 638*b* (which, as described below with reference to FIGS. 10A–10B can be used to form a generally cylindrical second antenna). The second conductive layer 632*b* can further include a receiver module connection site 654 having terminals for coupling to the receiver module 614 (FIG. 7). The second conductive layer 632*b* can still further include receiver circuitry 655 that couples the receiver module connection site 654 to the connector 670, and second antenna leads 653 that couple the receiver module connection site 654 to the second antenna conductor portions 638*b*.

In further aspects of this embodiment, the transmitter circuitry 645 and/or the receiver circuitry 655 can include other circuit elements, including resistors and/or capacitors 671 (shown as first resistors and/or capacitors 671*a* and second resisters and/or capacitors 671*b*). For example, in one aspect of this embodiment, the first resistors and/or capacitors 671 a can be used to control the impedance of the connection between the connector 670 and the transmitter module connection site 644 and/or the receiver module connection site 654. In another embodiment, the second resistors and/or capacitors 671*b* can be used to control the impedance between the module connection sites 644, 654 and the corresponding antenna conductor portions 638*a*, 638*b*.

In still a further aspect of an embodiment shown in FIG. 9, the substrate 631 can support the third conductive layer 632*c*. The third conductive layer 632*c* can include silver and/or another conductive material disposed on a polyimide or other dielectric material, which is in turn disposed on the exposed portions of the second conductive layer 632*b*. Accordingly, the third conductive layer 632*c* can be electrically isolated from the second conductive layer 632*b*. In yet another aspect of this embodiment, the third conductive layer 632*c* can be electrically coupled to portions of the first conductive layer 632*a* described above with reference to FIG. 8. For example, the third conductive layer 632*c* can include a second transmitter ground plane 642*b* electrically coupled to the first transmitter ground plane 642*a* (FIG. 8) with vias (not visible in FIG. 9). The third conductive layer 632*c* can further include a second receiver ground plane 652*b* coupled to the first receiver ground plane 652*a* (FIG. 8) with additional vias (also not visible in FIG. 9).

In one embodiment, the third conductive layer 632*c* can be added to the flexible circuit material 630 by first providing a dielectric material over the second conductive layer 632*b*. Via openings are then formed through the dielectric material and through the substrate material 631. Accordingly, the via openings can terminate adjacent to the first conductive layer 632*a* (FIG. 8). The third conductive material 632*c* (which can include a silver-filled conductive epoxy or other suitable materials) can be screened onto the underlying dielectric material to (a) fill the via openings and form corresponding vias and (b) form the second ground planes 642*b*, 652*b*. Accordingly, the second ground planes 642*b*, 652*b* can be coupled to the first ground planes 642*a*, 652*a*, respectively, by the conductive vias extending through the substrate 631.

One feature of an embodiment of the antenna assembly 610 described above with reference to FIGS. 6–9 is that the first antenna leads 643 can pass between two spaced apart transmitter ground planes 642*a*, 642*b*, and the second antenna leads 653 can pass between two spaced apart receiver ground planes 652*a*, 652*b*. One advantage of this feature is that the ground planes positioned on opposite sides of the antenna leads can provide for improved shielding of the antenna leads. Another advantage of this arrangement is that the impedance of one or more of the ground planes can be controlled to reduce and/or eliminate the likelihood for signal reflection at the corresponding antennas, as described in greater detail below with reference to FIG. 11. As a result, the strength of the signals transmitted and/or received at the antenna 611*a* or antenna 611*b* (FIG. 7) can be increased, which can reduce the likelihood for losing communication between the aircraft 100 (FIG. 1) and its ground station.

Figure 10A:
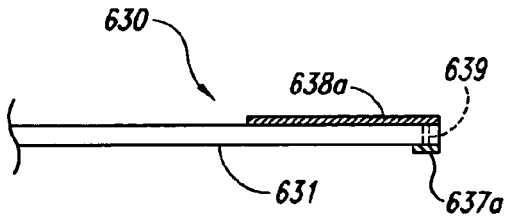
FIGS. 10A–10B illustrate a method for forming an antenna with a flexible circuit material in accordance with an embodiment of the invention.

FIG. 10A is a partially schematic, cross-sectional illustration of a portion of the flexible circuit material 630, taken substantially along line 10A—10A of FIG. 8. As shown in FIG. 10A, the flexible circuit material 630 can include an initially flat portion of the substrate 631, with the first antenna overlap connector 637*a* positioned on one side, and the first antenna conductor portion 638*a* positioned on the other. A conductive via 639 provides electrical continuity between the first antenna overlap connector 637*a* and the first antenna conductive portion 638*a*.

Figure 10B:
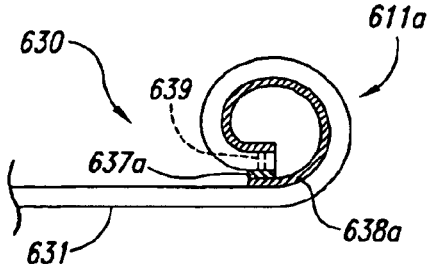

To form the first antenna 611*a* shown in FIG. 10B, the flexible circuit material 630 can be rolled until the first antenna overlap connector 637*a* overlaps and contacts the first antenna conductive portion 638*a*. With this arrangement, the first antenna 611*a* can have an electrically continuous, cylindrical dipole arrangement. One advantage of this feature compared, for example, with a flat or planer dipole antenna, is that the cylindrical first antenna 611*a* can provide for more omnidirectional signal reception and/or transmission.

Another feature of this arrangement is that the first antenna 611 a can be formed integrally with the circuitry to which it is connected (see FIG. 9). An advantage of this feature is that it can reduce the likelihood for breaks or other discontinuities between portions of the antenna circuitry.

Figure 11:
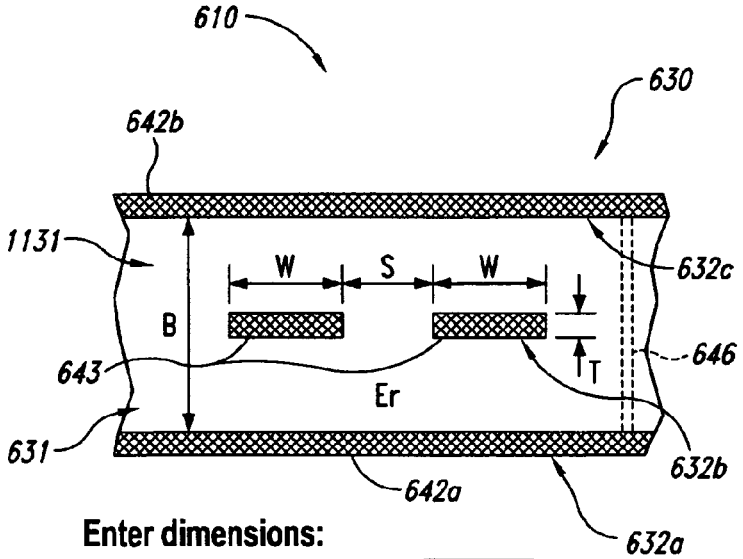
FIG. 11 is a partially schematic, cross-sectional view of a portion of the flexible circuit material, taken substantially along line 11—11 of FIG. 9.

FIG. 11 is a partially schematic, cross-sectional view of a portion of the antenna assembly 610, taken substantially along line 11—11 of FIG. 9. Also shown in FIG. 11 is a computer screen shot illustrating the inputs and outputs used by a computer-based calculator to calculate impedance for an arrangement of the antenna assembly 610. Such a calculator is available from a number of public sources, including the web site located at www.ideaconsulting.com, provided by Idea Consulting of Santa Cruz, Calif.

As shown in FIG. 11, the antenna assembly 610 can include the flexible circuit 630 having the substrate 631 with the first conductive layer 632*a* positioned adjacent to one surface, and the second conductive layer 632*b* positioned adjacent to an oppositely facing surface. An intermediate dielectric material 1131 can be disposed adjacent to the second conductive layer 632*b*, and the third conductive layer 632*c* can be positioned adjacent the intermediate dielectric layer 1131. The first conductive layer 632*a* can include the first transmitter ground plane 642*a*, the second conductive layer 632*b* can include the first antenna leads 643, and the third conductive layer 632*c* can include the second transmitter ground plane 642*b*. The width and thickness of each antenna lead 643 are represented by letters "W" and "T," respectively. Letter "S" represents the spacing between the antenna leads, letter "B" represents the distance between the first transmitter ground plane 642*a* and the second transmitter ground plane 642*b*, and letters "Er" indicate the relative dielectric constant of the material between the two transmitter ground planes 642*a*, 642*b*.

The impedance calculator can be used to determine the value or values of the forgoing variables that result in a trace impedance that reduces and/or eliminates the likelihood for signal reflection at the first antenna 611*a*. For example, in an embodiment shown in FIG. 11, W was chosen to be 0.008 inches, T was chosen to be 0.004 inches, S was chosen to be 0.020 inches, B was chosen to be 0.014 inches, and Er was chosen to be 3.5. The resulting impedance of 62.5 ohms is expected to reduce the likelihood for signal reflection for a ¼ wavelength dipole antenna transmitting at 2400 MHz. Accordingly, the size, shape, composition, and spacing of these elements can provide for passive termination of the antenna connections. In other embodiments, these variables can have other values, depending upon the particular geometry of the antenna assembly 610 and the characteristics of the signals transmitted and/or received with the antenna assembly 610. In any of these embodiments, the impedance can be further tailored by providing appropriate resistors and/or capacitors 671*b* (FIG. 9) at an interface between the first antenna leads 643 and the first antenna 611*a*.

From the foregoing, it will be appreciated that specific embodiments of the invention have been described herein for purposes of illustration, but that various modifications may be made without deviating from the spirit and scope of the invention. The invention is not limited except as by the appended claims.

I claim:

1. An aircraft system, comprising:

an aircraft antenna configured to be installed within a portion of an aircraft, the antenna including:

a flexible substrate material; and at least one flexible conductive material positioned adjacent to at least one surface of the substrate material, wherein at least portions of the flexible substrate material and the conductive material are disposed in a generally cylindrical manner about an elongated axis.

2. The system of claim 1, further comprising at least one circuit element formed in the at least one conductive material.

3. The system of claim 1, further comprising at least one conductive lead formed in the at least one conductive material.

4. The system of claim 1, further comprising a first conductive lead and a second conductive lead formed in the at least one conductive material, and wherein the first conductive lead and second conductive lead are electrically isolated from each other.

5. The system of claim 1 wherein the substrate material and the conductive material are rolled as a unit about the elongated axis to form a closed cylinder.

6. The system of claim 1 wherein the substrate material and the conductive material are rolled as a unit about the elongated axis to form a closed cylinder, and wherein the closed cylinder includes a first antenna and a second antenna.

7. The system of claim 1 wherein the at least one conductive material is integrally attached to the substrate material.

8. The system of claim 1 wherein the flexible substrate material includes a flexible, low dielectric insulator.

9. The system of claim 1 wherein the at least one flexible conductive material includes a low resistivity conductor.

10. The system of claim 1, further comprising the aircraft, and wherein the antenna is carried by the aircraft.

11. An aircraft system, comprising:

an aircraft antenna configured to be installed within a portion of an aircraft, the antenna including:

a flexible substrate material having a first surface and a second surface opposite the first surface;

a first conductive layer positioned adjacent to the first surface of the substrate; and a second conductive layer positioned adjacent to the second surface of the substrate, wherein at least portions of the flexible substrate material, the first conductive layer, and the second conductive layer are rolled about an axis into an at least partially cylindrical shape elongated along the axis.

12. The system of claim 11, further comprising at least one circuit element formed in at least one of the first and second conductive layers.

13. The system of claim 11, further comprising at least one conductive lead formed in the second conductive layer.

14. The system of claim 11 wherein at least portions of the substrate material, the first conductive layer, and the second conductive layer are rolled about the axis to form a closed cylinder.

15. The system of claim 11 wherein the at least portions of the substrate material, the first conductive layer, and the second conductive layer are rolled about the axis to form a closed cylinder, and wherein the closed cylinder includes a first antenna and a second antenna.

16. The system of claim 11 wherein the flexible substrate material includes a flexible, low dielectric insulator.

17. The system of claim 11 wherein at least one of the first and second conductive layers includes a low resistivity conductor.

18. The system of claim 11, further comprising a support material disposed at least partially within an interior surface of the cylinder formed by rolling the at least portions of the substrate material and the first and second conductive materials about an axis.

19. An aircraft antenna assembly, comprising:

a flexible substrate material substrate having a first side and a second side opposite the first side;

a first conductive layer positioned adjacent to the first side of the substrate, the first conductive layer including at least one ground portion coupleable to ground;

a second conductive layer positioned adjacent to the second side of the substrate, the second conductive layer including a transmitter portion and a receiver portion electrically isolated from the transmitter portion, the transmitter portion being positioned to be electrically coupled to a signal transmitter, the receiver portion being positioned to be electrically coupled to a signal receiver; and at least one antenna in electrical communication with at least one of the transmitter portion and the receiver portion, the at least one antenna being formed from at least a portion of the first and second conductive layers.

20. The antenna assembly of claim 19 wherein the at least one antenna includes a generally cylindrical dipole antenna formed by rolling at least a portion of the substrate material, the first conductive layer, and the second conductive layer about an axis into a generally cylindrical shape.

21. The antenna assembly of claim 19 wherein the first conductive layer includes at least one antenna overlap connector and the second conductive layer includes at least one antenna conductor portion, and wherein at least a portion of the substrate material, the first conductive layer, and the second conductive layer are rolled about an axis until the at least one antenna overlap connector contacts the at least one antenna conductor portion, forming a generally cylindrical antenna.

22. The antenna assembly of claim 19 wherein the at least one antenna includes a first antenna and a second antenna, the first antenna being electrically coupled to the transmitter portion and the second antenna being electrically coupled to the receiver portion, and wherein the first and second antennas are electrically isolated from each other.

23. The antenna assembly of claim 19, further comprising a third conductive layer positioned adjacent to the second conductive layer, the third conductive layer being electrically coupled to the first conductive layer and electrically isolated from the second conductive layer.

24. The antenna assembly of claim 19 wherein the at least one ground portion includes a first ground portion and a second ground portion, the first ground portion positioned to provide electrical shielding for the transmitter portion, the second ground portion positioned to provide electrical shielding for the receiver portion.

25. An aircraft antenna assembly, comprising:

a flexible substrate material having a first surface and a second surface opposite the first side;

a first conductive layer positioned adjacent to the first surface of the substrate material, the first conductive layer including at least one ground plane and at least one antenna overlap connector;

a second conductive layer positioned adjacent to the second surface of the substrate material, the second conductive layer including at least one antenna conductor portion, a transmitter portion, and a receiver portion;

a third conductive layer positioned adjacent to the second conductive layer, the third conductive layer being electrically coupled to the first conductive layer and electrically isolated from the second conductive layer; and at least one antenna in electrical contact with at least one of the transmitter portion and the receiver portion, the at least one antenna including at least a portion of the substrate material, the first conductive layer, and the second conductive layer rolled about an axis with the at least one antenna overlap connector in contact with the at least one antenna conductor portion.

26. The antenna assembly of claim 25 wherein the at least one antenna includes an at least generally cylindrical dipole antenna.

27. The antenna assembly of claim 25 wherein the at least one antenna includes a first antenna and a second antenna, the first antenna being electrically coupled to the transmitter portion and the second antenna being electrically coupled to the receiver portion.

28. The antenna assembly of claim 25, further comprising a third conductive layer positioned adjacent to the second conductive layer, the third conductive layer being electrically coupled to the first conductive layer and electrically isolated from the second conductive layer.

29. The antenna assembly of claim 25 wherein the at least one ground plane includes a first ground plane and a second ground plane, the first ground plane positioned to provide electrical shielding for the transmitter portion, the second ground plane positioned to provide electrical shielding for the receiver portion.

30. The antenna assembly of claim 25 wherein the transmitter portion includes a transmitter module coupled to a transmitter filter, and wherein the transmitter module includes an 800 mW video transmitter and the transmitter filter includes a 2400 MHz bandpass filter.

31. The antenna assembly of claim 25 wherein the receiver portion includes a receiver module coupled to a receiver filter, and wherein the receiver module includes a 900 MHz modem.

32. A aircraft system, comprising:

an unmanned aircraft including a lifting surface having a winglet;

an antenna package releasably positioned inside the winglet; and at least one antenna releasably positioned in the antenna package, wherein the at least one antenna includes a generally cylindrical antenna.

33. The system of claim 32 wherein the at least one antenna includes a generally cylindrical dipole antenna.

34. The system of claim 32 wherein the at least one antenna includes:

a flexible substrate material; and at least one flexible conductive material positioned adjacent to at least one surface of the substrate material, wherein at least portions of the substrate material and the conductive material are rolled about an axis into an at least partially cylindrical shape.

35. The system of claim 32 wherein the antenna package includes a receptacle portion having a flexible, undersized receptacle positioned to receive the antenna, and a cover portion coupled to the receptacle portion and movable relative to the receptacle portion between a closed position and an open position, the antenna being accessible when the cover portion is in the open position.

36. A method of forming an aircraft antenna, comprising:

providing a flexible substrate material having a first surface, a second surface facing opposite the first surface, and at least one flexible conductive material adjacent to at least one surface of the substrate material; and rolling at least a portion of the substrate material and at least a portion of the conductive material as a unit about an axis to form an at least partially cylindrical antenna elongated along the axis, wherein the antenna is configured to be installed within a portion of an aircraft.

37. The method of claim 36, further comprising forming at least one circuit element in the at least one conductive material.

38. The method of claim 36, further comprising forming at least one conductive lead in the at least one conductive material.

39. The method of claim 36, further comprising forming a first conductive lead and a second conductive lead in the at least one conductive material, and wherein the first conductive lead and second conductive lead are electrically isolated from each other.

40. The method of claim 36 wherein rolling at least a portion of the substrate material and at least a portion of the conductive material as a unit about an axis includes forming an antenna shaped as a closed cylinder elongated along an axis.

41. The method of claim 36 wherein:

the flexible substrate material has a first flexible conductive layer adjacent to the first surface and a second flexible conductive layer adjacent to the second surface; and rolling at least a portion of the substrate material and at least a portion of the conductive material as a unit includes rolling at least a portion of the substrate material and at least a portion of the first and second conductive layers as a unit about an axis to form an at least generally cylindrical antenna elongated along the axis.

42. The method of claim 36 wherein:

the flexible conductive material has a first flexible conductive layer adjacent to the first surface and a second flexible conductive layer adjacent to the second surface, the first conductive layer including at least one ground portion, the second conductive layer including a transmitter portion and a receiver portion; and rolling at least a portion of the substrate material and at least a portion of the conductive material as a unit includes rolling at least a portion of the substrate material and at least a portion of the first and second conductive layers as a unit about an axis to form at least one generally cylindrical antenna elongated along the axis, the at least one antenna being in electrical communication with at least one of the transmitter portion and the receiver portion.

43. The method of claim 36 wherein providing the flexible substrate material includes providing a flexible substrate material having a first flexible conductive layer adjacent to the first surface, a second flexible conductive layer adjacent to the second surface, and a third conductive layer adjacent to the second conductive layer, the third conductive layer being electrically coupled to the first conductive layer and electrically isolated from the second conductive layer.

44. The method of claim 36 wherein:

providing the flexible substrate material includes providing a flexible substrate material having a first flexible conductive layer with at least one antenna overlap connector adjacent to the first surface and a second flexible conductive layer with at least one antenna conductor portion adjacent to the second surface of the substrate material; and rolling at least a portion of the substrate material and at least a portion of the conductive material as a unit about an axis includes rolling at least a portion of the substrate material and at least a portion of the first and second conductive layers as a unit about the axis until the at least one antenna overlap connector contacts the at least one antenna conductor portion to form at least one generally cylindrical antenna.

45. The method of claim 36 wherein forming an at least partially cylindrical antenna elongated along the axis includes forming a first antenna and a second antenna, the first antenna being electrically isolated from the second antenna.

46. The method of claim 36, further comprising forming at least one ground portion being positioned to provide electrical shielding for the at least partially cylindrical antenna elongated along the axis.

47. The method of claim 36, further comprising installing the antenna in a winglet of an unmanned aircraft.

48. A method of forming an aircraft antenna, comprising:

providing a flexible substrate material having a first surface, a second surface opposite the first surface, a first conductive layer adjacent to the first surface and a second conductive layer adjacent to the second surface, the first conductive layer including at least one ground plane and at least one antenna overlap connector, the second conductive layer including at least one antenna conductor portion, a transmitter portion, and a receiver portion; and forming at least one generally cylindrical antenna by rolling at least a portion of the substrate material, the first conductive layer, and the second conductive layer as a unit about an axis until the at least one antenna overlap connector contacts the at least one conductor portion.

49. The method of claim 48, further comprising positioning a third conductive layer adjacent to the second conductive layer, the third conductive layer being electrically coupled to the first conductive layer and electrically isolated from the second conductive layer and the at least one overlap connector.

50. The method of claim 48 wherein forming the at least one generally cylindrical antenna includes forming a first antenna and a second antenna, the first antenna being electrically coupled to the transmitter portion and the second antenna being electrically coupled to the receiver portion.

51. A method of assembling an aircraft system, including:

removably installing at least one antenna in an antenna package, wherein the at least one antenna includes a generally cylindrical antenna;

removably installing the antenna package in a winglet of a lifting surface of an unmanned aircraft; and electrically coupling the antenna with an electrical system of the aircraft.

52. The method of claim 51, further comprising removably installing a transmitter and a receiver in the antenna package, and wherein the at least one antenna is electrically coupled to at least one of the transmitter and receiver.

53. The method of claim 51, further comprising removably installing a transmitter and a receiver in the antenna package, and wherein removably installing the at least one antenna includes removably installing a first antenna and a second antenna, the first antenna being electrically coupled to the transmitter and the second antenna being electrically coupled to the receiver.

54. The method of claim 51 wherein removably installing at least one antenna in an antenna package includes removably forcing the antenna into an undersized receptacle of the antenna package.

* * * * *

UNITED STATES PATENT AND TRADEMARK OFFICE

CERTIFICATE OF CORRECTION

PATENT NO. : 6,954,182 B2
DATED : October 11, 2005
INVENTOR(S) : Jeffrey Knapp

It is certified that error appears in the above-identified patent and that said Letters Patent is hereby corrected as shown below:

Title page,
Item [75], Inventor, "Seattle, WA (US)" should be -- Hood River, OR (US) --.

Signed and Sealed this

Eighteenth Day of April, 2006

JON W. DUDAS
*Director of the United States Patent and Trademark Office*